US007093473B2

(12) United States Patent
Honjo et al.

(10) Patent No.: US 7,093,473 B2
(45) Date of Patent: Aug. 22, 2006

(54) APPARATUS FOR MANUFACTURING BAND PLATE

(75) Inventors: Hisashi Honjo, Chiyoda-ku (JP); Takayuki Iwasaki, Chiyoda-ku (JP)

(73) Assignee: Ishikawajima-Harima Heavy Industries Co., Ltd., Tokyo (JP)

( * ) Notice: Subject to any disclaimer, the term of this patent is extended or adjusted under 35 U.S.C. 154(b) by 27 days.

(21) Appl. No.: 10/886,087

(22) Filed: Jul. 8, 2004

(65) Prior Publication Data

US 2005/0044916 A1 Mar. 3, 2005

(30) Foreign Application Priority Data

Aug. 4, 2003 (JP) ..... 2003-286014

(51) Int. Cl.
*B21B 29/00* (2006.01)

(52) U.S. Cl. ..... 72/243.6; 72/241.2; 72/247

(58) Field of Classification Search ..... 72/243.6, 72/247, 241.8, 242.2, 242.4, 241.2, 252.2; 29/527.7

See application file for complete search history.

(56) References Cited

U.S. PATENT DOCUMENTS 4,781,051 A * 11/1988 Schultes et al. ..... 72/247
4,864,836 A * 9/1989 Ochiai ..... 72/241.4
5,218,852 A * 6/1993 Watanabe et al. ..... 72/242.4
5,697,244 A * 12/1997 Seidel ..... 72/247
6,324,881 B1 * 12/2001 Benedetti et al. ..... 72/247

FOREIGN PATENT DOCUMENTS

JP 2002-011503 1/2002

OTHER PUBLICATIONS

Machine English translation of JP 2002-011503, www4.ipdl.ncipi.go.jp/cgi-bin/tran_web_cgi_ejje, downloaded Oct. 21, 2005, 13 pages.

* cited by examiner

*Primary Examiner*—Derris H. Banks
*Assistant Examiner*—Teresa M. Bonk
(74) *Attorney, Agent, or Firm*—Griffin & Szipl, P.C.

(57) ABSTRACT

An apparatus for manufacturing a band plate has a rolling mill that includes a pair of upper and lower work rolls that roll a slab material having edge drop portions at both ends thereof, and a pair of backup rolls that contact non-rolling side surfaces of the pair of upper and lower work rolls, respectively to prevent the work rolls from being deformed. The work roll includes a reverse taper portion where a roll diameter gradually increases towards a barrel end portion thereof corresponding to the edge drop portion. The upper and lower work rolls are configured to be shiftable individually in the axial direction thereof. The backup roll includes an escape portion whose diameter gradually decreases towards an axial end thereof so as not to contact the reverse taper portion of the work roll, within a shifting range of the work roll.

4 Claims, 4 Drawing Sheets

APPARATUS FOR MANUFACTURING BAND PLATE

This application claims priority from Japanese Patent Application No. 2003-286014, filed Aug. 4, 2003, the entire disclosure of which is incorporated herein by reference.

BACKGROUND OF THE INVENTION

1. Technical Field of the Invention

The present invention relates to an apparatus for manufacturing a band plate that presses edge drop portions at both ends of a plate before rolling, together with a center part of the plate, and leaves edge drops on the plate after rolling.

2. Description of the Related Art

FIGS. 1A and 2 are schematic views of a continuous casting machine of a double-roll type. As shown in these figures, when a slab of a predetermined width is manufactured using a continuous casting machine 50 (strip caster), casting metal in a molten state is passed through two rolls 51 (casting rolls) that rotate in reverse directions. Casting rolls 51 are separated by a predetermined gap that is appropriate for forming the thickness of a slab plate, and are installed in parallel and horizontally.

Molten metal for casting is supplied to a pouring basin formed between side dams 53 disposed between both ends of the casting rolls and a top portion of outer peripheries of casting rolls 51, from an opening of a flat-shaped nozzle 52 of a tundish arranged immediately above (top portion of) the two casting rolls 51. Both side dams 53 are disposed to match the width of the slab to be manufactured, and to prevent molten metal from leaking onto the side surfaces of the ends of casting rolls having the same length as the width of the slab.

The continuous casting machine 50 of a double-roll type manufactures a slab with a predetermined approximate width of 1,200 to 2,000 mm. The continuous casting equipment of a double-roll type can operate using simple ancillary equipment in a compact layout compared to other continuous casting apparatus such as caterpillar-type continuous casting equipment.

When a slab material that has been manufactured with double rolls or a single roll is rolled by a rolling mill 56 downstream on the line, the rolling mill is a conventional non-shifting mill, instead of using a rolling mill in which rolls are shifted in the axial direction of the roll. Conventionally, a roll of the rolling mill has a shape of a parabolic or sinusoidal curve, and have diameters larger at the axial center of the roll than at the ends (barrel-shaped rolls). Barrel-shaped rolls are widely used in a conventional rolling mill to compensate for warping of the pressing roll.

However, the aforementioned continuous casting machine 50 of a double-roll type suffers from a heat crown phenomenon at the casting rolls during casting, because of the long casting roll 51. As a result of this heat crown phenomenon, casting conditions vary along the width of the casting roll. In particular, the variation at the width ends of the work roll becomes greater. Therefore, at the position nearer to the width ends of the roll, the distribution of a plate thickness in the lateral (width) direction of a slab varies more largely.

In addition, because side dams 53 are disposed at both ends of the rolls, heat dissipation efficiencies are high at the roll surfaces that are in contact with side dams; along a lateral section of the slab, portions close to the roll width ends are cooled more efficiently than at the center, so the plate thickness changes from the center to the width ends, resulting in a concave or convex shape. As a result, as shown in FIG. 1B for instance, the section of the slab is tapered at both ends; or conversely, the thickness of the slab may increase at both ends. In the following description, the sectional shape of a slab with tapered ends is called an "edge-drop crown," and the shape with elevated ends is called an "edge-up crown."

The inventors of the present invention have already invented a technique and applied it for a patent. This technique is described in Patent literature 1 correcting the edge drop or up crown described above. Patent literature 1 "Band plate manufacturing apparatus" discloses a continuous casting machine of a double-roll or single-roll type, that continuously casts a slab of a predetermined width with molten metal for casting, supplied from a tundish arranged at an upstream location, and a single finish rolling mill that is disposed downstream of the continuous casting machine, and is provided with a pair of up/down work rolls that can move along the axes thereof in opposite directions. As shown in FIG. 3, each of the upper and lower work rolls 61, 62 is shaped for the roll crown such that a diameter of the work roll is made to decrease over a part to one end of the work roll from a position separated by 200 mm from the one end of the work roll, and a diameter of the work roll is made to increase over a part to the other end of the work roll from a position separated by 200 mm from the other end of the work roll. In addition, the work roll profile (outline) between the diameter-changing points is formed as a straight line or an united shape of the straight line and a center convex shape. In other words, each work roll 61 or 62 is a ground crown roll. In addition, both rolls with the roll crown described above are disposed point-symmetrically about a rolling center such that the diameter-decreasing and diameter-increasing part of the upper work roll are respectively positioned at opposite sides of the diameter-decreasing and diameter-increasing part of the lower work roll.

[Patent Literature 1]

Japanese Laid-Open Patent publication No. 11503, 2002

As described above, a plate to be rolled by a rolling mill may have a large edge drop. In particular, a strip caster often produces large edge drops, so slabs manufactured therewith must be specially processed.

Furthermore, edge drops produced by a strip caster can often differ at both ends, because molten metal solidifies differently near both side dams. Therefore, a means for controlling edge drops in a way that differs for left and right side portions is required.

Generally, if the edge drops of a raw material is large and the material is rolled so deeply that edge drops are eliminated, the elongation ratio at a center portion, originally free from edge drops, becomes excessively high, resulting in a problem of undulation produced at the center portion. Therefore, as shown typically in FIG. 4, it is required that both center portion and edge drop portions are rolled so as to leave the edge drops at both end portions after rolling. In FIG. 4, "BEFORE ROLLING" indicates a shape of the plate before rolling, and "AFTER ROLLING" indicates a shape of the plate after rolling.

SUMMARY OF THE INVENTION

The present invention aims to cope with these requests. That is, an object of the present invention is to provide an apparatus for manufacturing a band plate that can roll respective edge drops together with the center portion, leaving edge drops after rolling, even in a case of large edge drop portions in a plate before rolling and sizes of edge drops that differ between left and right edges of the plate.

According to the present invention, there is provided an apparatus for manufacturing a band plate, comprising a rolling mill that includes: a pair of upper and lower work rolls that roll a slab material having edge drop portions at both ends thereof; and a pair of backup rolls that contact non-rolling side surfaces of the pair of upper and lower work rolls, respectively to prevent the work rolls from being deformed, wherein the work roll comprises a reverse taper portion where a roll diameter gradually increases towards a barrel end portion thereof corresponding to the edge drop portion, the upper and lower work rolls are configured to be shiftable individually in the axial direction thereof, and the backup roll comprises an escape portion whose diameter gradually decreases towards an axial end thereof so as not to contact the reverse taper portion of the work roll, within a shifting range of the work roll.

According to a preferred embodiment of the present invention, the work roll comprises a cylindrical expansion diameter portion outside the reverse taper portion, and the backup roll comprises a cylindrical contraction diameter portion that contacts the expansion diameter portion, outside the escape portion.

Preferably, the apparatus for manufacturing the band plate further comprises a work roll bending mechanism that applies a bending moment to the work roll to finely adjust a crown during rolling.

Preferably, the apparatus for manufacturing the band plate further comprises a strip caster at a downstream side of which the rolling mill is provided.

According to the aforementioned configuration of the present invention, because the work roll is provided with the reverse taper portion, on which roll diameters gradually increase towards the barrel end portion thereof corresponding to the edge drop part, and the upper or lower work roll is composed to be shiftable individually in the axial direction of the roll, even if edge drops at both ends of the slab material differ greatly from each other, the shape of the rolled plate can be maintained under the preferred conditions by separately axially shifting the upper and lower work rolls.

Also, because the backup roll is provided with the escape portion at which roll diameters gradually decrease towards an end of the axis of the roll within the shiftable range of the work roll, so that the backup roll does not come into contact with the reverse taper portion of the work roll, the reverse taper portion of the work roll can be prevented from interfering with the backup roll, so the work roll can be axially shifted with a small resistance.

In addition, the crown can be finely adjusted during rolling, by applying a bending moment to the work roll by means of the work roll bending mechanism etc.

Other objects and advantages of the present invention are revealed as follows, referring to the attached drawings.

DESCRIPTION OF THE PREFERRED EMBODIMENTS

Figure 1A:
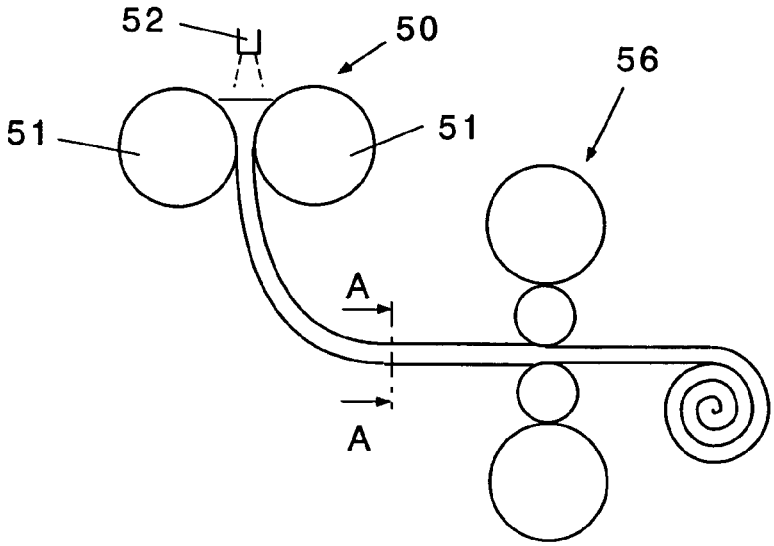
FIG. 1A PRIOR ART
FIGS. 1A and 1B are schematic views of a conventional continuous casting machine of a double-roll type.
Figure 1B:
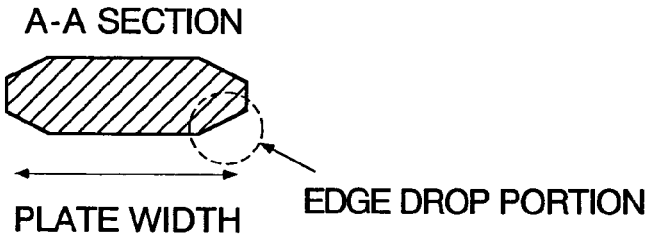
FIG. 1B PRIOR ART
Figure 2:
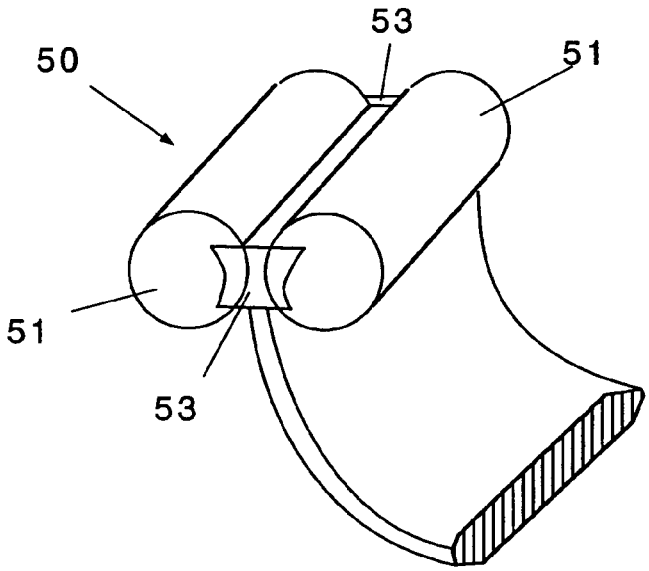
FIG. 2 PRIOR ART
FIG. 2 is another schematic view of the conventional double-roll-type continuous casting machine.
Figure 3:
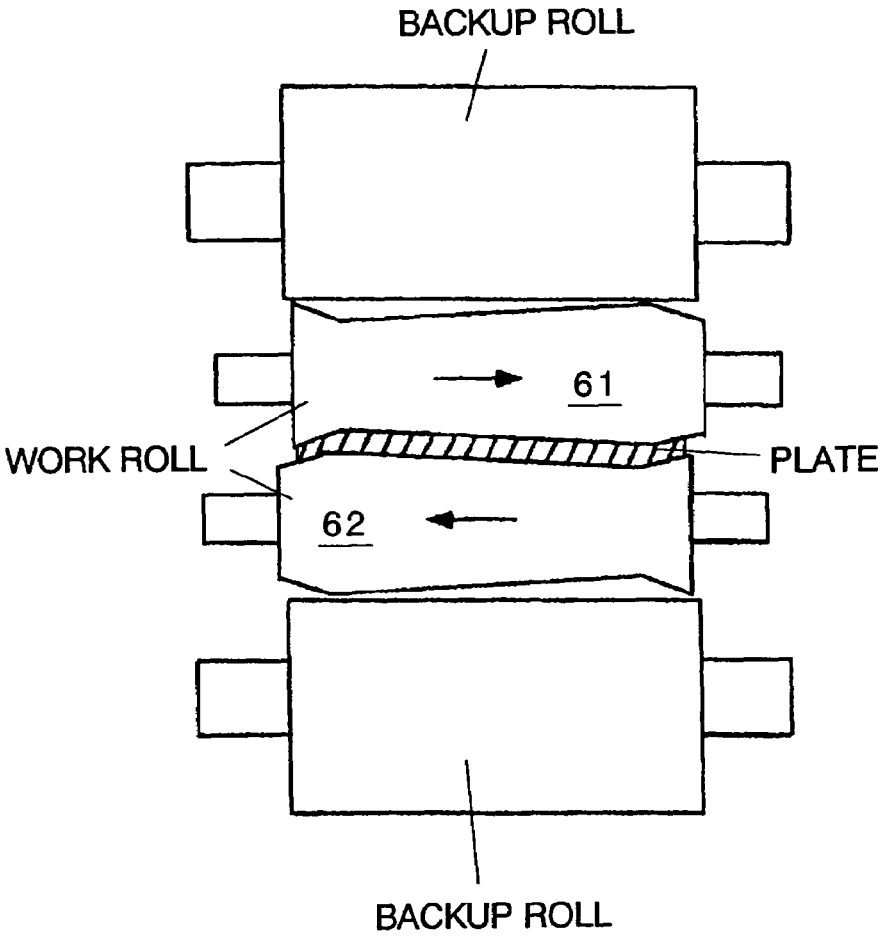
FIG. 3 PRIOR ART
FIG. 3 typically shows the "Band Plate-Manufacturing Apparatus" according to Patent literature 1.
Figure 4:
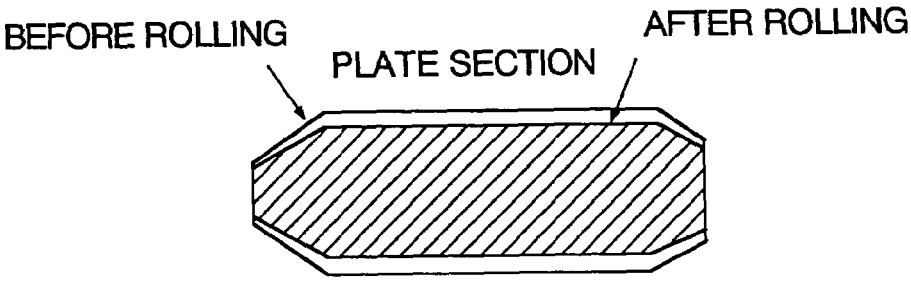
FIG. 4 PRIOR ART
FIG. 4 shows a preferred state of rolled edge drops.

Preferred embodiments of the present invention are described below referring to the drawings. In each drawing, common parts and components are identified with the same numbers, while omitting any duplicate descriptions.

Figure 5:
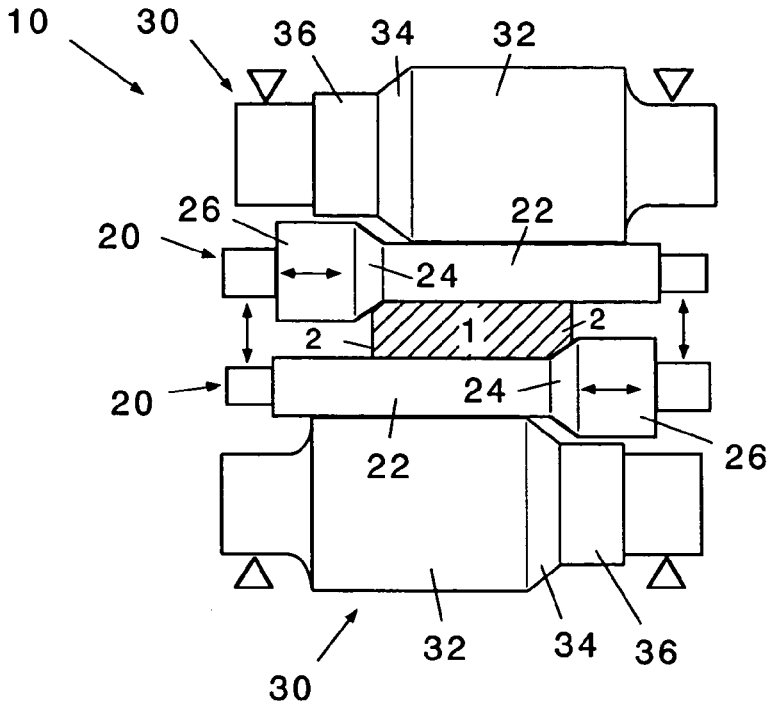
FIG. 5 illustrates the first embodiment of the apparatus for manufacturing a band plate according to the present invention.
Figure 6:
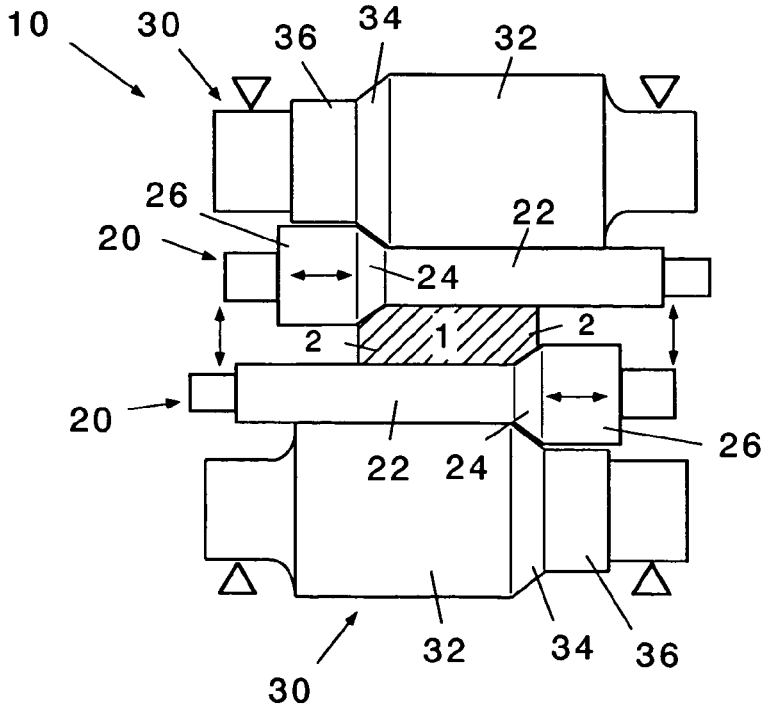
FIG. 6 shows another state of the apparatus shown in FIG. 5.

FIG. 5 shows the first embodiment of the apparatus for manufacturing a band plate according to the present invention; FIG. 6 shows another operating status of the apparatus in FIG. 5.

The apparatus for manufacturing a band plate of the present invention is preferably provided with a rolling mill 10 arranged downstream from a strip caster. In FIG. 5, this rolling mill 10 is composed of a pair of upper and lower work rolls 20 and a pair of upper and lower backup rolls 30.

The work roll 20, in a pair of upper and lower rolls, is provided with a rolling portion 22 formed in a slim cylinder, and can press a slab material 1 with edge drop portions 2 at both ends thereof. The backup roll 30, in a pair of upper and lower rolls, is shaped to have a backup portion 32 in a small cylinder, and contacts the non-rolling side surface of the work roll 20 in the pair, and can protect the work roll 20 from being bent and deformed. The backup roll 30 is supported by bearings, illustrated as triangles in FIG. 5, at both ends thereof in a rotatable manner.

In FIG. 5, the work roll 20 is sequentially composed of a reverse taper portion 24 and the expansion diameter portion 26 at the barrel end part of the cylindrical rolling portion 22. The reverse taper portion 24 is positioned at the barrel end part corresponding to the edge drop 2 of the slab material 1, and has a reverse taper in which the diameter gradually increases towards the axial end. The expansion diameter portion 26 is placed outside the reverse taper portion, and has a cylindrical shape.

The upper and lower work rolls 20, as a pair, preferably has the same shape and, as shown in FIG. 5, are disposed point-symmetrically about the center of the rolling mill.

Both upper and lower work rolls 20 are configured to be shiftable individually in the respective axial directions by means of a roll shifting device, which is not illustrated but is shown by the horizontal arrow marks.

Furthermore, as shown by the arrow marks in the vertical direction of the roll, a work roll bending mechanism (not illustrated) is incorporated at both ends of the work roll 20, whereby the crown of the slab material 1 is finely adjusted during rolling by applying the bending moment.

In FIG. 5, the backup roll 30 is shaped to have an escape portion 34 and the contraction diameter portion 36, disposed sequentially, at the barrel end part of the cylindrical backup portion 32. The profile of the escape portion 34 has a taper as the roll diameters gradually decrease towards the axial end such that the escape portion 34 does not contact the reverse taper portion 24 of the work roll within a shiftable range of the work roll 20. The contraction diameter portion 36 is located outside the escape portion, and has a cylindrical shape.

A pair of upper and lower backup rolls 30 preferably have the same shape. As shown in FIG. 5, they are arranged point-symmetrically about the center of the rolling mill.

In this example, the expansion diameter portion 26 of the work roll and the contraction diameter portion 36 of the backup roll are arranged so as not to come into contact with each other. In other words, the expansion diameter portion 26 and the contraction diameter portion 36 are not functionally indispensable, so they can be omitted from the configuration.

FIGS. 5 and 6 show medium-sized edge drop (called medium edge drop) and large-sized edge drop (called large edge drop) of work rolls, respectively in the above-mentioned rolling mill.

In FIG. 5, upper and lower work rolls 20 are shifted by a small stroke corresponding to the medium edge drop, and roll a center portion and edge drop 2 of slab material 1, at the same time. In FIG. 6, the shift stroke of work rolls 20 is large in proportion to the large edge drop, while simultaneously rolling the center portion and edge drop 2 of slab material 1.

Rolling conditions of the slab center portion are adjusted by a rolling load applied by backup rolls 30. Conditions for rolling edge drop portions 2 are adjusted by the shifting stroke of the work rolls, as well as the rolling load. In addition, the work roll bending mechanism imposes a bending moment that finely adjusts the crown of slab material 1 during rolling.

Figure 7:
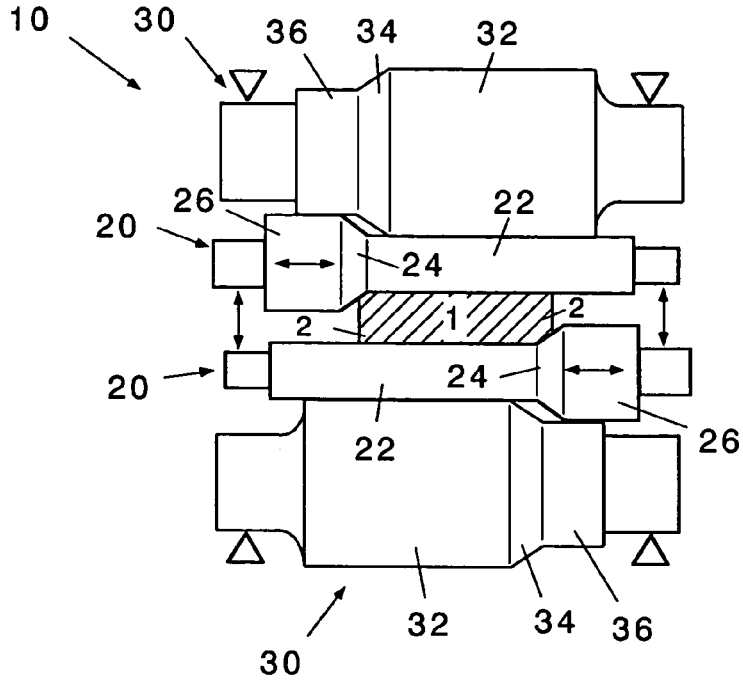
FIG. 7 shows the state of the second embodiment of the apparatus for manufacturing a band plate according to the present invention.
Figure 8:
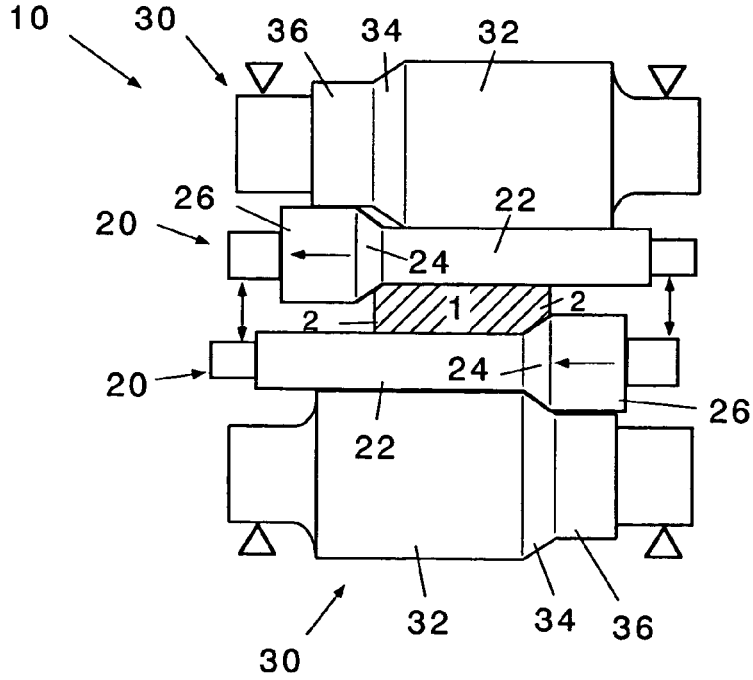
FIG. 8 is a view showing another operating state of the apparatus in FIG. 7.

FIG. 7 shows the second embodiment of the apparatus for manufacturing a band plate according to the present invention, and FIG. 8 shows another operation state of the apparatus shown in FIG. 7.

In this embodiment, the expansion diameter portion 26 of the work roll and the contraction diameter portion 36 of the backup roll are in contact with each other. Therefore, in this example, expansion and contraction diameter portions 26, 36 functions, differently from the first embodiment. Other configuration details are the same as those in the first embodiment.

FIG. 7 is a view in which shifting strokes of upper and lower work rolls 20 are the same for this apparatus; and FIG. 8 represents a case where shifting strokes of upper and lower work rolls 20 differ from each other.

In FIG. 7, like the operation state of the first embodiment, the depth of rolling the center portion of the slab is adjusted by the rolling load applied from the back up roll 30, and the depth of the rolling of edge drop portion 2 is adjusted by the rolling load, a shifting stroke of the work roll and work roll bending. In this case, because the expansion diameter portion 26 of the work roll is backed up by the contraction diameter portion 36 of the backup roll, the effects of work roll bending are low at the expansion diameter portion side and high at the opposite side.

In FIG. 8, the shifting strokes of upper and lower work rolls 20 are different; in this embodiment, both rolls shift leftwards in FIG. 8. As a result, even where edge drops 2 of slab material 1 are small and large at the left and right sides, both edges can be rolled at the same time. Other effects are the same as those related to FIG. 7.

According to the configuration of the present invention, as described above, because the work roll 20 is provided with a reverse taper portion 24 at which diameters gradually increase towards the barrel end part corresponding to edge drop 2, and the upper and lower work rolls are configured such that they can individually be shifted in the axial direction, even if the edge drops at both ends of the slab material differ considerably from each other, the shape of the rolled plate can be maintained in good condition by separately shifting upper and lower work rolls in the axial direction.

Because the backup roll 30 is equipped with the escape portion 32 where diameters gradually decrease towards the axial end so that the roll does not contact the reverse taper portion of the work roll, the reverse taper portion of the work rolls can be prevented from interfering with the backup roll, and the work roll can be shifted axially with a low resistance.

In addition, the crown can be finely adjusted by means of a work roll bending mechanism that applies a bending moment to the work rolls.

The present invention should of course not be limited only to the aforementioned embodiments, but can be modified in various ways provided there are no deviations from the claims of the present invention.

The invention claimed is:

1. An apparatus for manufacturing a band plate, comprising a rolling mill that includes:

a pair of upper and lower work rolls that roll a slab material having edge drop portions at both ends thereof; and a pair of backup rolls that contact non-rolling side surfaces of the pair of upper and lower work rolls, respectively to prevent the work rolls from being deformed, wherein each work roll comprises i. a rolling portion:

ii. a reverse taper portion at a barrel end portion of the rolling portion; and iii. a cylindrical expansion diameter portion outside the reverse taper portion, the barrel end portion corresponding to the edge drop portion of the slap material, wherein the reverse taper portion has a roll diameter that gradually increases towards the expansion diameter portion, the upper and lower work rolls are configured to be shiftable individually in the axial direction thereof, and each backup roll comprises an escape portion and a cylindrical contraction diameter portion outside the escape portion, wherein the escape portion has a diameter that gradually decreases towards the contraction diameter portion so as not to contact the reverse taper portion within a shifting range of the work roll, and the cylindrical contraction diameter portion of each backup roll contacts the expansion diameter portion of one of the upper and lower work rolls.

2. The apparatus for manufacturing the band plate, according to claim 1, further comprising a work roll bending mechanism that applies a bending moment to the work roll to finely adjust a crown during rolling.

3. The apparatus for manufacturing the band plate, according to claim 1, further comprising a strip caster at a downstream side of which the rolling mill is provided.

4. The apparatus for manufacturing the band plate, according to claim 2, further comprising a strip caster at a downstream side of which the rolling mill is provided.

* * * * *